United States Patent [19]

Copp, Jr. et al.

[11] 4,351,227

[45] Sep. 28, 1982

[54] MULTICYLINDER SWASH PLATE COMPRESSOR PISTON RING ARRANGEMENT

[75] Inventors: Carl A. Copp, Jr., Vandalia; Richard T. Pandzik; Marvin E. Gaines, both of Dayton, all of Ohio

[73] Assignee: General Motors Corporation, Detroit, Mich.

[21] Appl. No.: 151,707

[22] Filed: May 20, 1980

[51] Int. Cl.[3] ..... F04B 1/18

[52] U.S. Cl. ..... 92/71; 417/269

[58] Field of Search ..... 417/269, 313; 92/71

[56] References Cited

U.S. PATENT DOCUMENTS

| | | | |
|---|---|---|---|
| 3,215,341 | 11/1965 | Francis | 230/186 |
| 3,885,460 | 5/1975 | Park | 92/249 |
| 3,904,320 | 9/1975 | Kishi et al. | 417/269 |
| 3,924,968 | 12/1975 | Gaines et al. | 417/53 |
| 3,930,758 | 1/1976 | Park | 417/269 |
| 3,999,894 | 12/1976 | Nakayama | 417/269 |
| 4,101,250 | 7/1978 | Nakayama et al. | 417/269 |
| 4,135,862 | 1/1979 | Degawa | 417/269 |

*Primary Examiner*—William L. Freeh
*Attorney, Agent, or Firm*—R. L. Phillips

[57] ABSTRACT

A compact lightweight multicylinder swash plate compressor is disclosed having a metallic double-ended piston with piston heads reciprocated in aligned metallic cylinder bores. Each piston head has a diametrical dimension substantially less than the diametrical dimension of its respective bore to provide a substantial annular space therebetween and a solid seal-support ring of slippery material is expanded over each piston head and contracts into a circumferential groove therein. Each ring is sufficiently thick that the memory recovery thereof after further contraction forced by a tool causes the ring to sealingly engage its respective bore immediately after assembly with its piston head therein. The metal of the piston head on opposite sides of the groove is thereby prevented from touching the metal of its respective bore throughout its reciprocation in the bore. Each ring groove is formed with a plurality of projections which are spaced about and project outward from the bottom thereof. The projections project sufficiently outward and are configured so that they substantially bite or imbed themselves in the underside of the ring mounted thereover during assembly of the piston heads with the rings thereon in their respective bores. Each piston is thereby positively prevented from both rotary and longitudinal rubbing movement in its rings to thereby prevent the rings from wearing away the metal of the piston heads at the bottom and shoulders of their groove whereby both sealing and prevention of metal to metal contact between the piston heads and their respective bores is maintained by the rings.

3 Claims, 16 Drawing Figures

MULTICYLINDER SWASH PLATE COMPRESSOR PISTON RING ARRANGEMENT

This invention relates to multicylinder swash plate compressor piston ring arrangements and more particularly to such an arrangement employing a solid seal-support ring. It is an improvement in the swash plate compressor in co-pending U.S. patent application Ser. No. 966,067 filed Dec. 4, 1978 and assigned to the assignee of this invention.

The present invention is directed to improvement in the use of a solid seal-support ring on a double-ended piston used in a compact lightweight multicylinder swash plate compressor. In such a compressor, the heads of aluminum pistons are reciprocated in aligned cylinder bores of a two-piece cylinder block and each have a diametrical dimension substantially less than that of its respective bore to provide a substantial annular space therebetween. The solid seal-spport ring is made of slippery material such as Teflon or the like and is expanded over the end of each piston head and then contracts into a circumferential groove therein. The seal-support ring is sufficiently thick that the memory recovery thereof after further contraction forced by a tool causes the ring to sealingly engage its respective bore immediately after assembly with its piston head therein. Moreover, the metal of the piston head on opposite sides of the groove is then prevented by such ring from touching the metal of its respective cylinder bore throughout its reciprocation in the bore. In such an arrangement it has been found that the pistons can rotate and also move longitudinally in the rings. This rubbing movement can wear away the metal of the piston heads at the bottom and shoulders of their groove and thereby cause loss of sealing and permit undesirable metal to metal contact between the piston heads and the respective bores.

The present invention is directed to solving such problems by improving the structural relationship between the piston and its rings. According to the present invention, there is now formed on the bottom of the ring groove on each piston head a plurality of projections which are spaced about and project outward therefrom. The projections are preferably configured as raised bars or ridges that extend at opposite angles to the piston's centerline and project sufficiently outward so that they substantially bite or imbed themselves along their length in the underside of the ring stretched thereover during assembly of the piston' heads with the ring therein in their respective bores. As a result, during compressor operation the pistons are thereby positively prevented from both rotation and longitudinal rubbing movement in their rings to thereby prevent the rings from wearing away the piston heads whereby both sealing and prevention of metal to metal contact between the piston heads and their respective bore is maintained by the rings.

These and other objects, advantages and features of the present invention will become more apparent from the following description and drawings in which.

Figure 1:
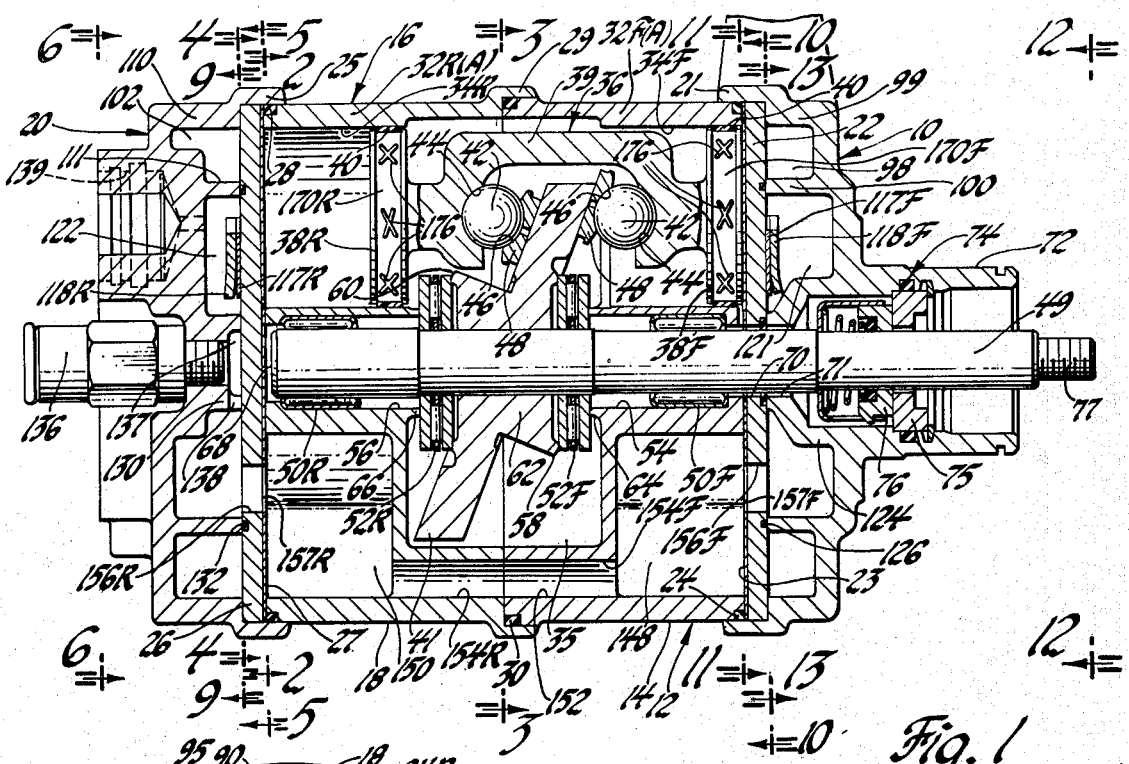
FIG. 1 is a longitudinal sectional view taken along the line 1—1 in FIG. 2 of a swash plate type refrigerant compressor for vehicle use embodying the present invention.
Figures 15, 16:
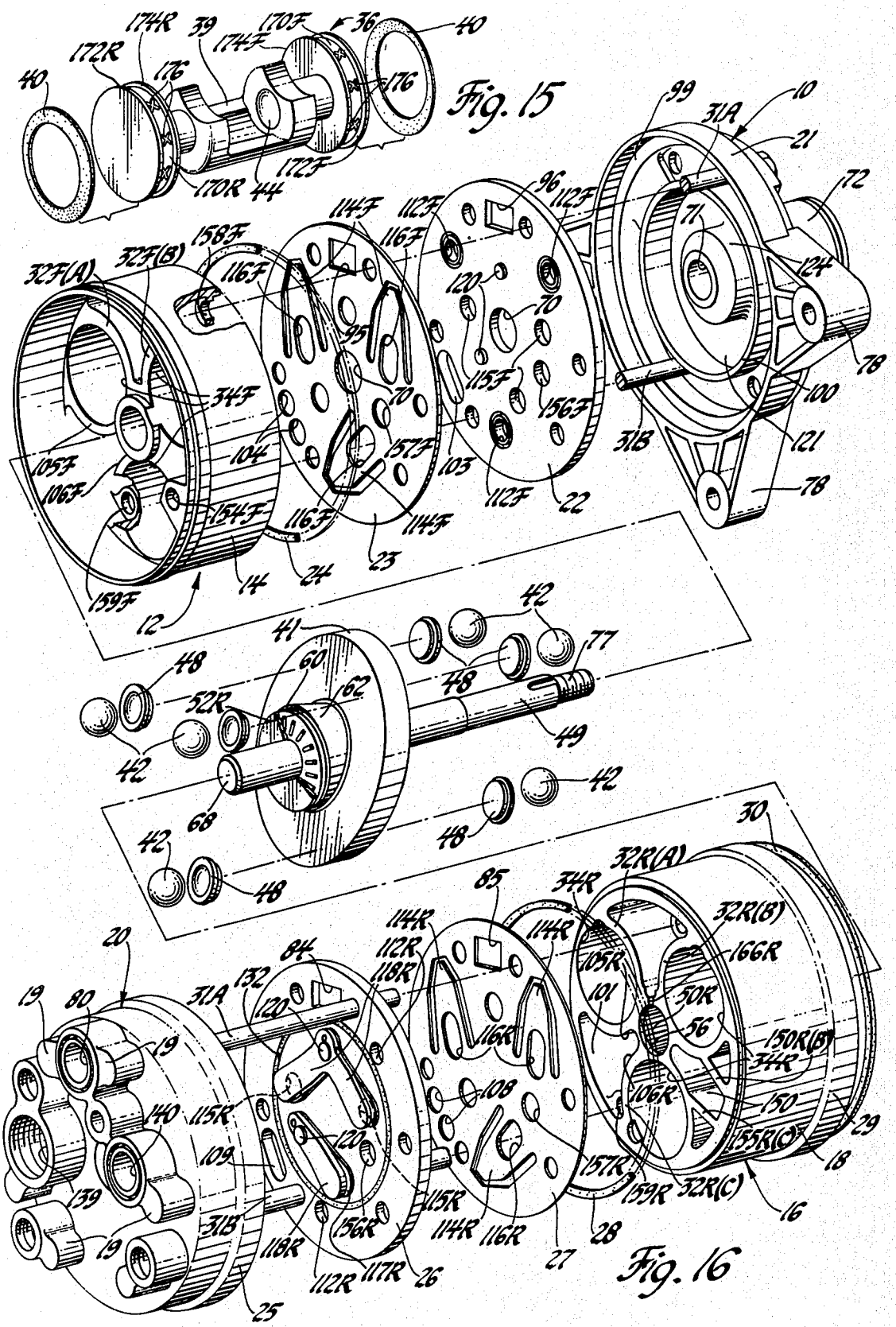
FIG. 15 is an exploded view of one of the pistons and its rings from the refrigerant compressor in FIG. 1.
FIG. 16 is an exploded view of the refrigerant compressor in FIG. 1 excluding the pistons.

Referring to the drawings, there is shown a swash plate type refrigerant compressor intended for vehicle use having incorporated therein the preferred embodiment of the present invention. The compressor assembly includes a plurality of die cast aluminum parts; namely, a front head 10, a front cylinder block 12 with integral cylindrical case or shell 14, a rear cylinder block 16 with integral cylindrical case or shell 18 and a rear head 20. As can be seen in FIGS. 1 and 16, the front head 10 has a cylindrical collar 21 which telescopically fits over the front end of the front cylinder block shell 14 with both a rigid circular front valve plate 22 of steel and a circular front valve disk 23 of spring steel sandwiched therebetween and with an O-ring seal 24 provided at their common juncture. Similarly, the rear head 20 had a cylindrical collar 25 which telescopically fits over the rear end of the rear cylinder block shell 18 with both a rigid circular rear valve plate 26 of steel and a circular rear valve disk 27 of spring steel sandwiched therebetween and with an O-ring seal 28 providing sealing at their common juncture. Then at the juncture of the cylinder blocks, the rear cylinder block shell 18 has a cylindrical collar 29 at its front end which telescopically fits over the rear end of the front cylinder block shell 14 and there is provided an O-ring seal 30 to seal this joint in the transversely split two-piece cylinder block thus formed.

All the above metal parts are clamped together and held by six (6) bolts 31 at final assembly after the assembly therein of the internal compressor parts later described. The bolts 31 extend through aligned holes in the front head 10, valve plates 22, 26 and valve disks 23, 27 and either alignment bores and/or passages in the cylinder blocks 12, 16 (as described in more detail later) and are threaded to bosses 19 formed on the rear head 20. The heads 10 and 20 and cylinder block shells 14 and 18 have generally cylindrical profiles and cooperately provide the compressor with a generally cylindrical profile or outline of compact size characterized by its short length as permitted by the piston and piston ring structure described in detail later.

Figure 2:
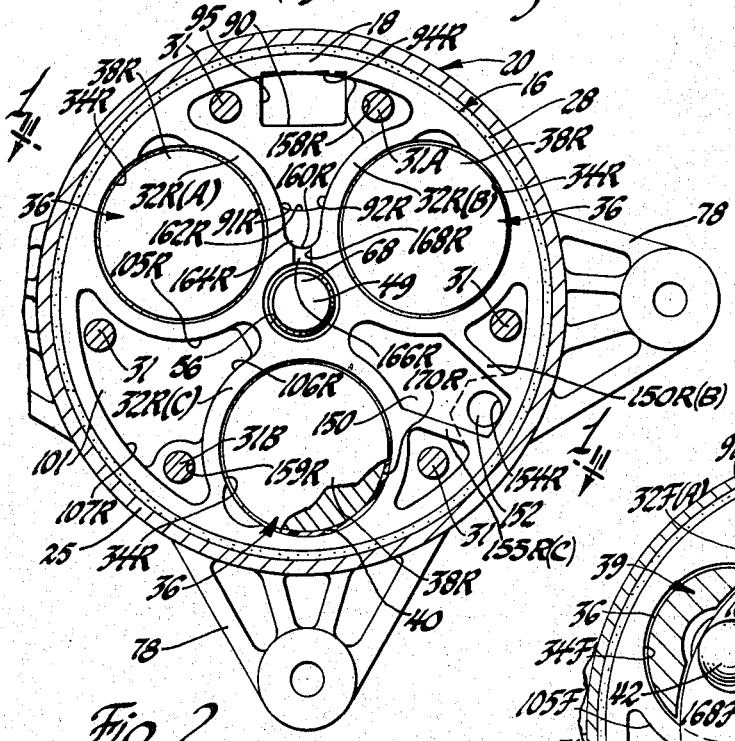
FIG. 2 is a view taken along the line 2—2 in FIG. 1 with the upper two cylinder bores oriented parallel to each other.
Figure 3:
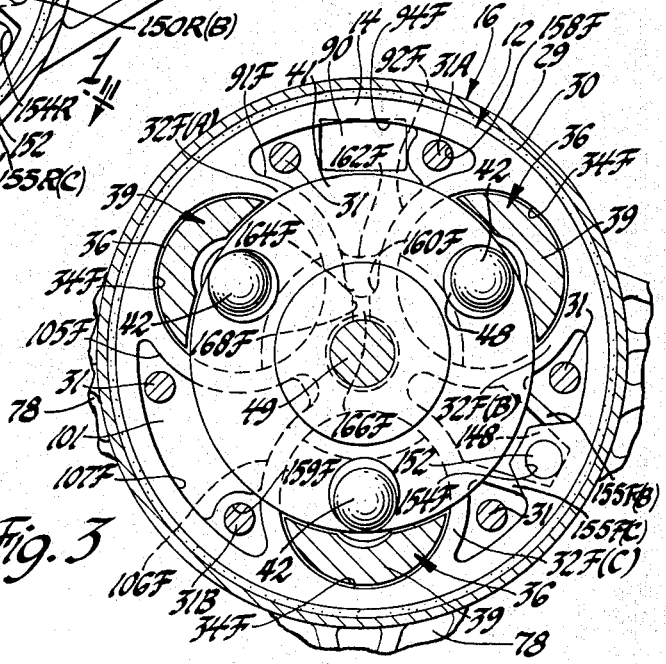
FIG. 3 is a view oriented like FIG. 2 and taken along the line 3—3 in FIG. 1.

The front and rear cylinder blocks 12 and 16 each have a cluster of three equally angularly and radially spaced and parallel thin-wall cylinders 32(F) and 32(R), respectively (the suffixes F and R being used herein to denote front and rear counterparts in the compressor). The thin-wall cylinders 32(F) and 32(R) in each cluster are integrally joined along their length with each other both at the center of their respective cylinder block 12 and 16 and at their respective cylinder block shell 14 and 18 as can be seen in FIGS. 2 and 3. The respective front and rear cylinders 32(F) and 32(R) each have a cylindrical bore 34(F) and 34(R) all of equal diameter and the bores in the two cylinder blocks are axially aligned with each other and closed at their outboard end by the respective front and rear valve disk 23 and 27 and valve plate 22 and 26. The oppositely facing inboard ends of the aligned cylinders 32(F) and 32(R) are axially spaced from each other and together with the remaining inboard end details of the cylinder blocks 12 and 16 and the interior of their respective integral shell 14 and 18 form a central crankcase cavity 35 in the compressor. In what will be referred to as the normal or in-use orientation of the compressor, the three pair of aligned cylinders are located as seen in FIGS. 2 and 3 at or close to the two, six and ten o'clock positions with the two adjoining upper cylinders in each cylinder block designated 32(A) and 32(B) and the lowermost cylinder designated 32(C).

A symmetrical double-ended piston 36 of aluminum is reciprocally mounted in each pair of axially aligned cylinder bores 34(F), 34(R) with each piston having a short cylindrical front head 38(F) and a short cylindrical rear head 38(R) of equal diameter which slides in the respective front cylinder bore 34(F) and rear cylinder bore 34(R). The two heads 38(F) and 38(R) of each piston are joined by a bridge 39 spanning the cavity 35 but are absent any sled runners and instead are completely supported in each cylinder bore by a single solid (non-split) seal-support ring 40 mounted in a circumferential groove on each piston head as described in more detail later.

The three pistons 36 are driven in conventional manner by a rotary drive plate 41 located in the central cavity 35. The drive plate 41, commonly called a swash plate, drives the pistons from each side through a ball 42 which fits in a socket 44 on the backside of the respective piston head 38 and in a socket 46 in a slipper 48 which slidably engages the respective side of the swash plate. The swash plate 41 is fixed to and driven by a drive shaft 49 that is rotatably supported and axially contained on opposite sides of the swash plate in the two-piece cylinder block 12, 16 by a bearing arrangement including axially aligned front and rear needle-type journal bearings 50(F), 50(R) and front and rear needle-type thrust bearings 52(F), 52(R).

The front journal bearing 50(F) and rear journal bearing 50(R) are mounted respectively in a central bore 54 in the front cylinder block 12 and a central bore 56 in the rear cylinder block 16 and it is important that these bores, like the cylinder bores in the blocks, be closely aligned with each other. The front thrust bearing 52(F) and rear thrust bearings 52(R) are mounted respectively between an annular shoulder 58, 60 on the respective front and rear side of hub 62 of the swash plate 41 and an annular shoulder 64, 66 on the respective inboard end of the front and rear cylinder blocks 12, 16. The rear end 68 of the drive shaft 49 terminates within the rear cylinder block shaft bore 56 which is closed by the center of the rear valve plate 26. On the other hand, the drive shaft 49 extends outward of the front cylinder block shaft bore 54 through a central hole 70 in the front valve plate 22 and thence on outwardly through an aligned hole 71 in a tubular extension 72 which projects outwardly from and is integral with the front head 10.

Figure 12:
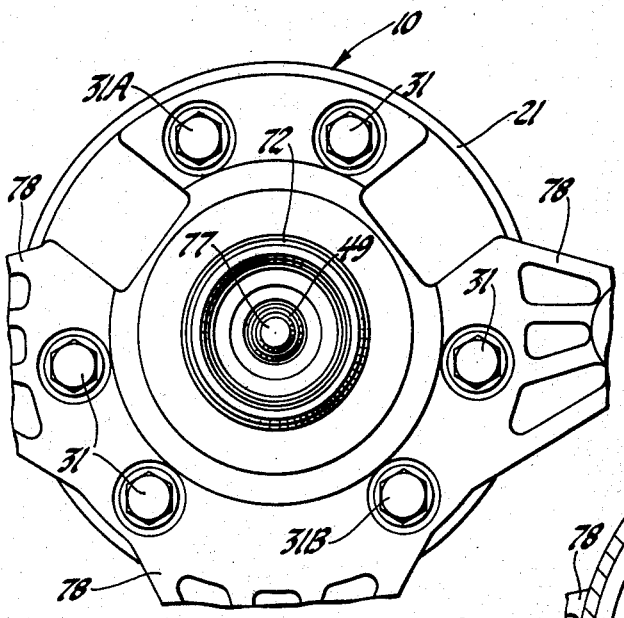
FIG. 12 is a view oriented like FIG. 2 and taken along the line 12—12 in FIG. 1.
Figure 13:
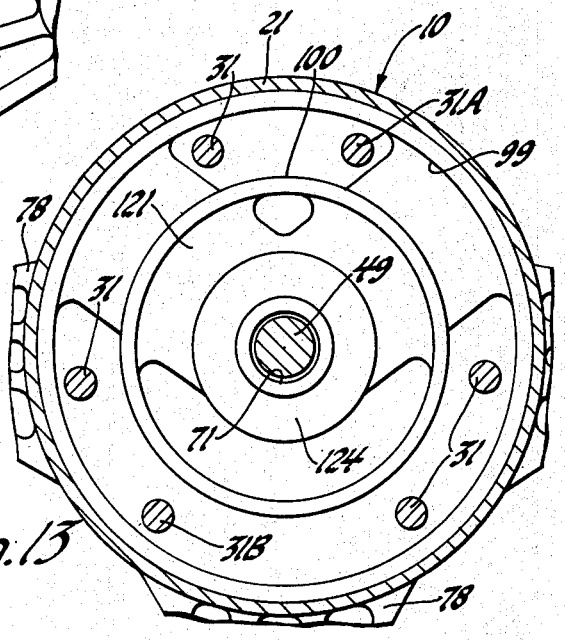
FIG. 13 is a view oriented like FIG. 2 and taken along the line 13—13 in FIG. 1.

As shown in FIG. 1, a rotary seal assembly 74, including a stationary seal 75 and a spring biased rotary seal 76 that engages therewith, provides sealing between the drive shaft 49 and front head 10 within the tubular extension 72. Outboard this seal arrangement the drive shaft 49 is adapted to be secured with the aid of a thread 77 on the end thereof to a clutch of conventional type, not shown, which is engageable to clutch the shaft to a pulley, also not shown, which is concentric therewith and in the case of vehicle installation is belt driven from the engine. For mounting the compressor, three mounting arms 78 are integrally formed with the front head 10 at the three, six and nine o'clock positions as seen from the front end in FIG. 12 so that the force due to the drive tension is transferred directly to the mounting bracket to which these arms are to be attached. This has been found to eliminate the possibility of motion between the front head 10 and the two-piece cylinder block 12, 16 which could result in shaft seal misalignment.

Figure 9:
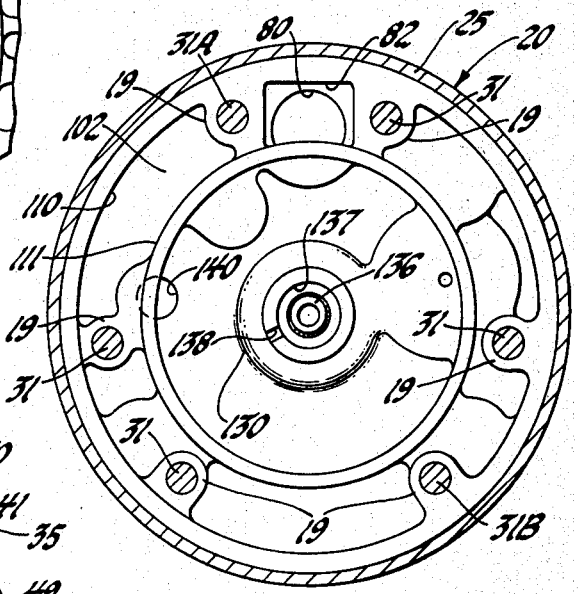
FIG. 9 is a view oriented like FIG. 2 and taken along the line 9—9 in FIG. 1.
Figure 8:
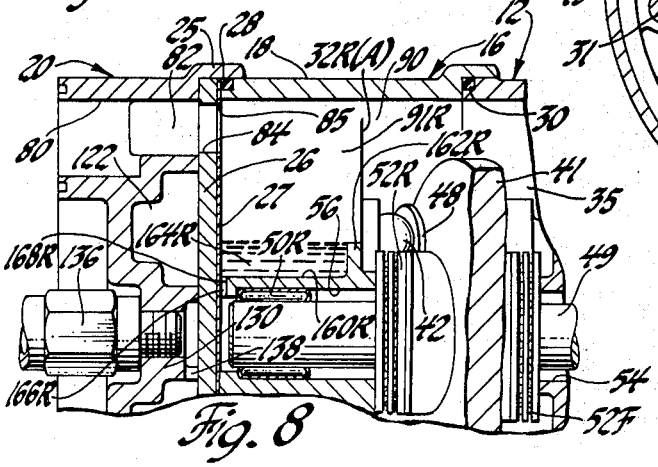
FIG. 8 is a view taken along the line 8—8 in FIG. 6.

Describing now the refrigerant flow system within the compressor, gaseous refrigerant with some oil entrained therein enters through an inlet 80 in the rear head 20 and into a cavity 82 in the rear head as can be seen in FIGS. 8 and 9. The entering refrigerant is directed through the rear cavity 82 through a rectangular shaped aperture 84 in the rear valve plate 26 and a corresponding aperture 85 in the rear valve disk 27 into a refrigerant transfer and oil separation passage 90 which extends the length of the two-piece cylinder block 12, 16 and opens intermediate its length to the central crank-case cavity 35. The longitudinally extending refrigerant transfer and oil separation passage 90 is defined by certain internal structure of the compressor so as to induce oil separation from the passing refrigerant. This oil separation structure primarily includes the adjoining longitudinally extending outer convex surface 91(F), 92(F) and 91(R), 92(R) of the two adjoining upper cylinder walls 32(A), 32(B) of the respective front and rear cylinder blocks 12, 16 and by, but only secondarily, the longitudinally extending interior concave surface 94(F), 94(R) of the respective front and rear cylinder block shells 14, 18 as will become more apparent later.

Figure 4:
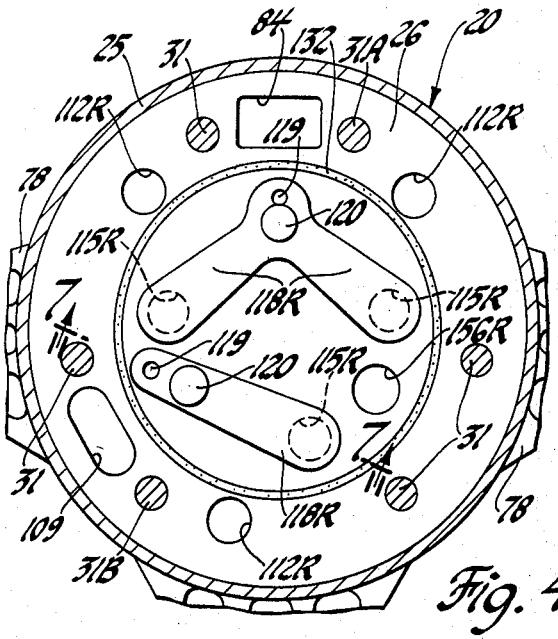
FIG. 4 is a view oriented like FIG. 2 and taken along the line 4—4 in FIG. 1.
Figure 5:
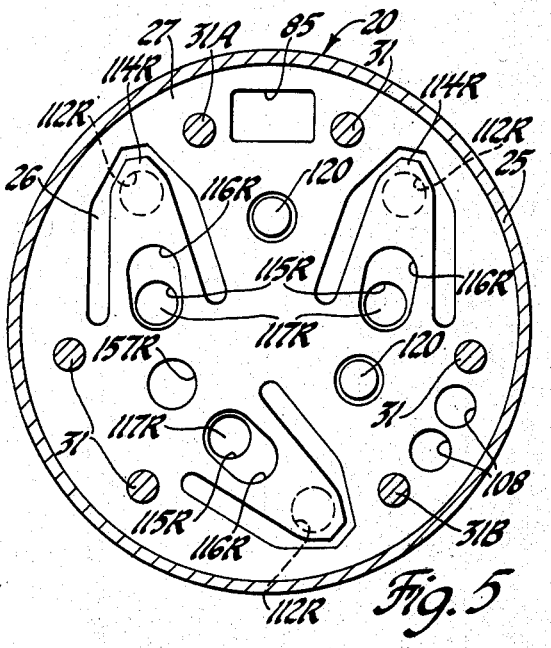
FIG. 5 is a view oriented like FIG. 2 and taken along the line 5—5 in FIG. 1.
Figure 6:
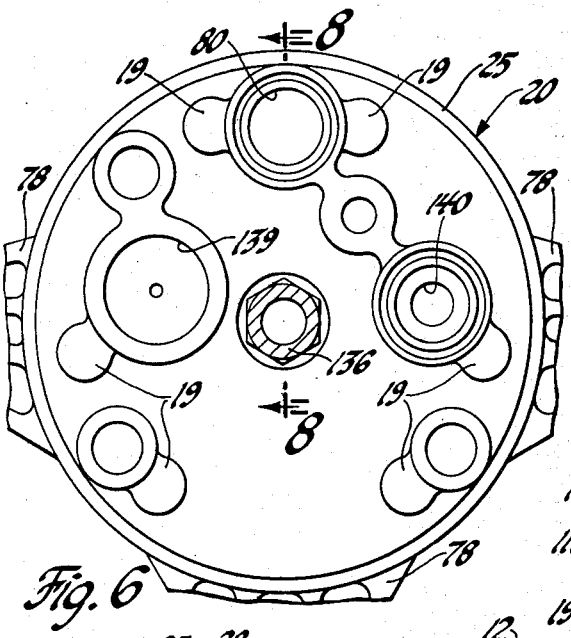
FIG. 6 is a view oriented like FIG. 2 and taken along the line 6—6 in FIG. 1.
Figure 7:
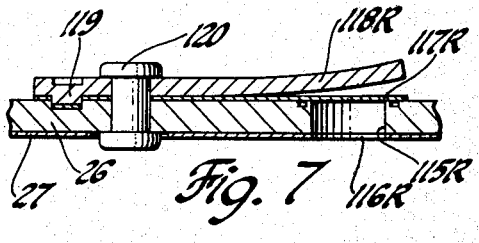
FIG. 7 is a view taken along the line 7—7 in FIG. 4.
Figure 10:
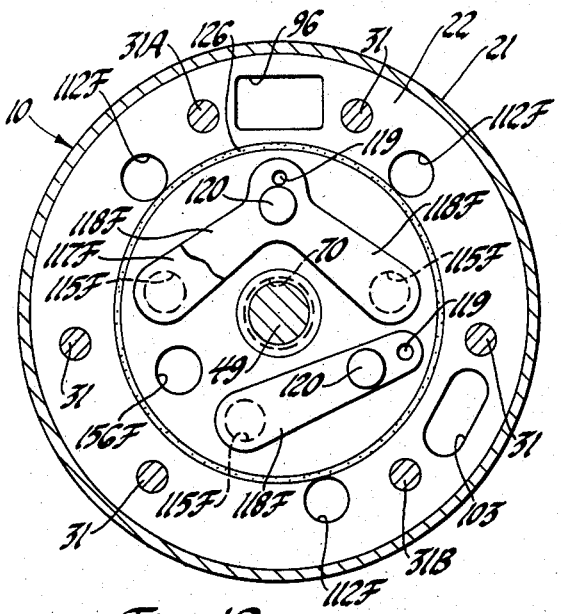
FIG. 10 is a view oriented like FIG. 2 and taken along the line 10—10 in FIG. 1.
Figure 11:
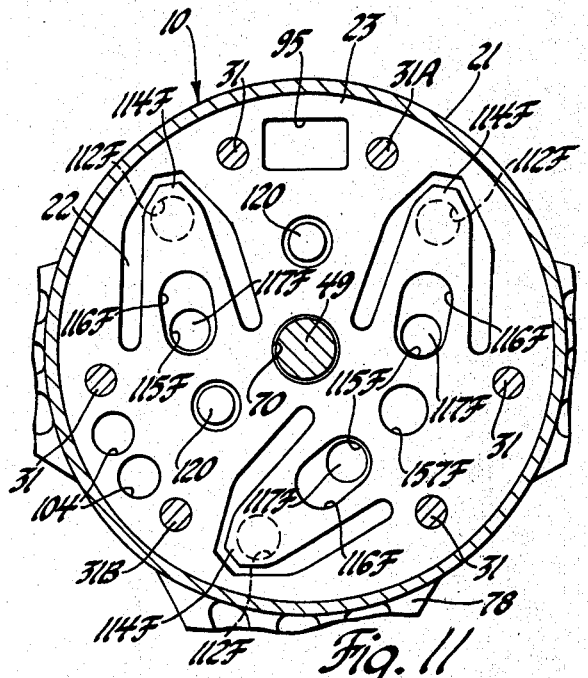
FIG. 11 is a view oriented like FIG. 2 and taken along the line 11—11 in FIG. 1.

The refrigerant transfer and oil separation passage 90 is open in the front end of the compressor through a rectangular shaped aperture 95 in the front valve disk 23 and a corresponding aperture 96 in the front valve plate 22 to an annular front suction chamber 98 in the front head 10. The front suction chamber 98 is formed by the inboard side of the front head 10 and an external and internal cylindrical wall 99, 100, respectively, extending inboard therefrom and by the outboard side of the front valve plate 22. The front suction chamber 98 is in turn connected by a crossover suction passage 101 extending longitudinally within the compressor between the cylinder walls 32(A) and 32(C) to a rear suction chamber 102 in the rear head 20. The front suction chamber 98 is open to the crossover suction passage 101 through an oblong aperture 103 in the front valve plate 22 (see FIGS. 10 and 16) and a pair of circular apertures 104 in the front valve disk 23 (see FIGS. 11 and 16). The suction crossover passage 101 extends the length of the two-piece cylinder block 12, 16 and is formed by the adjoining longitudinally extending outer convex surface 105(F), 106(F), and 105(R), 106(R) of the two adjoining cylinder walls 32(A), 32(C) of the respective front and rear cylinder blocks 12, 16 and by the longitudinally extending interior concave surface 107(F), 107(R) of the respective cylinder block shells 18, 14. The crossover suction passage 101 at the rear end of the compressor is to the rear suction chamber 102 open through a pair of circular apertures 108 in the rear valve disk 27 (see FIGS. 5 and 16) and an oblong aperture 109 in the rear valve plate 26 (see FIGS. 4 and 16). As can be seen in FIGS. 1, 8 and 9, the rear suction chamber 102 is a partial or split annulus by separation of the inlet cavity 82 and is formed by the inboard side of the rear head 20 and an external and internal partial cylindrical wall 110, 111, respectively, extending inboard therefrom and by the outboard side of the rear valve plate 26.

The refrigerant received in the respective front and rear suction chamber 98, 102 which is primarily from the crankcase cavity 35 is admitted to the piston head end of the respective cylinder bores 34(F), 34(R) through separate suction ports 112(F), 112(R) in the respective front and rear valve plates 22, 27 (see FIGS. 4, 5, 10, 11 and 16). Opening of the suction ports 112(F), 112(R) during the respective piston suction stroke and closing during the piston discharge stroke is effected by separate reed-type suction valve 114(F), 114(R) on the piston side of the valve plates which are formed in the front valve disk 23 and rear valve disk 27 respectively (see FIGS. 5 and 11).

Then for discharge of the refrigerant upon compression thereof in the cylinders, there are formed separate discharge ports 115(F), 115(R) in the respective valve plates 22, 26 with these discharge ports located at the piston end of the respective cylinder bores 34(F), 34(R) and open thereto through oblong apertures 116(F), 116(R) in the respective valve disks 23, 27 (see FIGS. 4, 5 and 10, 11). Opening and closing of the respective discharge ports 115(F), 115(R) is effected by separate reed-type discharge valves 117(F), 117(R) of spring steel which are backed up by rigid retainers 118(F), 118(R). The discharge valve 117(F), 117(R) and their respective retainers 118(F), 118(R) are each fixed as seen in FIGS. 4, 7, 10 and 16 by an integral pin and blind hole interlock 119 and a rivet 120 to the outboard side of the front valve plate 22 and rear valve plate 26 respectively and it will be noted that the discharge valves and retainers for the two upper cylinders in each cylinder block are of siamesed construction.

The respective discharge ports 115(F), 115(R) are opened by their discharge valves 117(F), 117(R) to an annular discharge chamber 120, 122 in the respective front and rear heads 10 and 20. The front discharge chamber 120 is formed by the inboard side of the front head 10 and the interior cylindrical wall 100 and an inboard projecting extension 124 of the tubular portion 72 of the front head and by the outboard side of the front valve plate 22. The inwardly projecting annular extension 124 on the front head 10 engages and thereby braces the center of the front valve plate 22 about the drive shaft 49. An O-ring seal 126 is mounted in a circular groove in the outboard side of the front valve plate 22 and is engaged by the flat annular radial face of the interior cylindrical wall 100 of the front head to provide sealing between the front suction chamber 98 and front discharge chamber 120. At the opposite or rear end of the compressor, the rear discharge chamber 122 is formed by the inboard side of the rear head 20, the interior cylindrical wall 111 of the rear head and a central boss 130 extending from the inboard side of the rear head and by the outboard side of the rear valve plate 26. An O-ring seal 132 is mounted in a circular groove in the outboard side of the rear valve plate and is engaged by the flat annular radial face of the interior wall 111 of the rear head to provide sealing between the rear suction chamber 102 and rear discharge chamber 122. The central boss 130 engages and thereby braces the center of the rear valve plate 26 and in addition has a conventional high pressure relief valve 136 threaded thereto. The relief valve 136 is open to the discharge chamber 122 through a central axial bore 137 and a radial port 138 in the boss 130 to provide high pressure relief operation. In addition, there is formed a port 139 in the rear head 20 that is open to the rear discharge chamber 122 and is adapted to receive a conventional pressure switch, not shown.

The discharge chambers 120 and 122 in the opposite ends of the compressor are connected to deliver the compressed refrigerant in a pulse attenuated state to an outlet 140 in the rear head 20 which opens directly to the rear discharge chamber 122. This pulse attenuated state is accomplished by connection of the two discharge chamber 120, 122 through two large volume attenuation chambers 148 and 150 which are formed in the outboard end of the respective cylinder blocks 12 and 16 between their cylinder walls 32(B) and 32(C) and are interconnected by a long, small-flow-area attenuation passage 152 formed by a matching bore 154(F), 154(R) in these respective cylinder blocks (see FIGS. 1–5, 10, 11 and 16). As best seen in FIGS. 1–3 and 16, two radially and longitudinally extending partitions 155(F) (B), 155(F) (C) and 155(R) (B), 155(R) (C) in the respective front and rear cylinder blocks 12, 16 together with the respective integral shells 14 and 18 define the peripheral wall of the respective attenuation chambers 148, 150 and separate them from the two bolts 31 which extend through the cylinder blocks between their cylinder walls 32(B) and 32(C). Connection is then provided directly between the discharge chambers 120, 122 and the respective attenuation chambers 148, 150 by a transfer port 156(F), 156(R) in the respective valve plates 22, 26 and a corresponding aperture 157(F), 157(R) in the respective valve disks 23, 27 (see FIGS. 4, 5 and 10, 11). As a result, the discharge gas pulses from each of the cylinders at the opposite ends of the compressor first experience a large chamber (i.e. their respective discharge chamber 120 or 122) and are then permitted to be transmitted in restricted manner through a small port (i.e. port 156(F) or 156(R)) to a first attenuation chamber (i.e. chamber 148 or 150) and thereafter through a long passage of restricted size (i.e. passage 152) and thence into a second attenuation chamber (i.e. chamber 150 or 148) and eventually to the other discharge chamber (i.e. discharge chamber 122 or 120). The three discharge pulses emitted from the cylinders at each end of the compressor are out of phase with each other but in phase with those at the opposite end and it has been found that by prescribing a certain relationship between the volume and length of the attenuation chambers and the flow area and length of the passage connecting them, the above internal gas discharge network in the compressor operates to substantially attenuate the gas pulses issuing from the compressor at the outlet 140 to the extent that no external or auxiliary muffler is required. For example, in an actual construction of the compressor disclosed herein having a total displacement of about 164 $cm^3$, it was found that with the volume and length of each attenuation chamber 148, 150 made about 12.3 $cm^3$ and 30 mm respectively, and the flow area and length of the connecting attenuation passage 152 made about 40 $mm^3$ and 49 mm, respectively, no objectionable vibrations were observed at a conventional condenser and/or evaporator served by the compressor.

In addition, it has been found that the attenuation bores 154(F), 154(R) which align with each other to form the passage 152 interconnecting the attenuation chambers 148 and 150 can be made to contribute significantly in simplifying the manufacture of the two cylinder blocks 12 and 16 by permitting their processing as separate pieces on an assembly line rather than perfecting marriage between two particular cylinder blocks and having to then process both on down the line. This is accomplished by first locating and boring the bore 154(F), 154(R) in each cylinder block on the assembly line and then locating off this bore at the various work stations, such as with a locator pin, for all further processing of this part. As a result, it is possible to accurately locate and then machine the cylinder and shaft bores and other critical details in each cylinder block piece with automatic equipment so that they have the required close alignment with their counterpart(s) or other associated structural details in any other cylinder block piece. This accurate cylinder block alignment is then positively established and maintained at final assembly by two of the six bolts 31 designated as 31(A) and 31(B) which are located generally opposite each other relative to the compressor centerline. The two bolts 31(A) and 31(B) are the only bolts that are required to fit, and closely so, with matching holes 158(F), 158(R) and 159(F), 159(R) that are accurately located off of the respective locator bores 154(F), 154(R) and bored in internal bosses in the respective cylinder blocks 12 and 16 (see FIGS. 2, 3 and 16).

The compressor has no oil lubricating pump mechanism as such and instead has a passive lubrication system which separates out and strategically deploys the oil entrained in the entering refrigerant to lubricate all of the compressor's internal sliding and bearing surfaces. The lubrication system utilizes the suction crossover passage 90 and particularly the external sides 91(F), 92(F), and 91(R), 92(R) of the two upper cylinder walls 32(A) and 32(B) in each cylinder block whose heat operates to separate the oil that is entrained in the refrigerant, with the oil then draining down into the respective valleys 160(F), 160(R) formed by these walls (see FIGS. 2, 3, 8 and 16). The respective valleys 160(F), 160(R) are dammed at their outboard end in the respective cylinder blocks by the respective front and rear valve disks 23 and 27 but would normally be open at their opposite or inboard end to the central cavity 35 in which the swash plate 41 rotates. However, a dam 162(F), 162(R) is formed integral with the two upper cylinder walls 32(A) and 32(B) in each cylinder block across the respective valley 160(F), 160(R) at its inboard end so as to form an oil catch basin 164(F) and 164(R) in the respective front and rear cylinder block that is elevated directly above the respective front and rear journal bearing 50(F) and 50(R) when the compressor is mounted in its normal position or any position rotated in either direction therefrom in a range of ±45° about the compressor centerline. The oil catch basins 164(F), 164(R) are connected to drain to the respective journal bearings 50(F), 50(R) by a vertical passage 166(F), 166(R) respectively, these oil passages being formed by a vertical radial groove 168(F), 168(R) in the outboard face of the respective cylinder blocks 12, 16 such that the oil is permitted to drain straight down along the inboard side of the respective valve disks 23, 27 and into the respective shaft accommodating bores 54, 56 and thence directly to the outboard end of the respective journal bearings 50(F), 50(R).

Thus, oil is caught in the oil catch basins 164(F), 164(R) during compressor operation and is delivered during continued operation first to the respective journal bearings 50(F), 50(R) and thence delivered inboard through the respective bores 54, 56 and along the drive shaft 49 to the thrust bearings 52(F), 52(R) from which such oil is eventually flung outward therethrough and onto the opposite sides of the swash plate 41 to lubricate the ball and slipper drive connections with the pistons 36. Furthermore, the oil catch basins 164(F), 164(R) also serve to retain a portion of the oil caught therein during compressor operation for use after each intermittent stop as normally occurs in the operation of the compressor in vehicle use so that oil is immediately available to be delivered to the bearings in the same sequence each time compressor operation is restarted. Thus, continuous oil wetting of all the bearings is assured during intermittent compressor operation.

As is well known, the mass of the swash plate 41 has the characteristic of dynamically balancing the reciprocation of the pistons during rotation of the swash plate. Furthermore, the length of the double-ended pistons 36 has the characteristic of delimiting the minimum length of the compressor and thus the compactness thereof. Normally, a commercial compressor of the swash plate type has piston heads with axially extending sled runners for taking the side loads which result from the piston's forced directions of movement by the cylinder bores while the conventional rings mounted thereon serve to seal rather than bear any substantial portion of the side loading. Such sled runners not only contribute to the weight of the pistons and to the length of the pistons and cylinders, they also substantially limit the ability of the pistons to tilt to accommodate any misalignment between the cylinder bores. To reduce the mass required of the swash plate 41 and also minimize the criticality of axial alignment of the cylinder bores, the heads 38(F), 38(R) of the pistons 36 are made extremely short and without sled runners and are provided with a diametrical dimension less than the diametrical dimension of their cylinder bores 34(F), 34(R) to provide a space therebetween enabling the seal-support ring 40 between each piston head and its respective bore to be made sufficiently thick so that is provides full radial support of the piston head within its cylinder bore as well as sealing with the metal of the piston head then not allowed to touch the metal of its respective cylinder bore throughout its reciprocation therein. See FIGS. 1 and 14–16. Each piston head 38(F), 38(R) is provided with a sufficiently short longitudinal or axial dimension along its bores so as to produce a sufficient circumscribing area on the piston head in juxtaposition with the bore to permit the wear resistance of the seal-support rings 40 to approximate the life of the compressor while the weight of the piston head is reduced. In addition, the pistons have essentially only sufficient material in their bridge 39 to hold the piston heads together during reciprocation so that the weight of the piston is further reduced. With such piston weight reduction, the mass of swash plate 41 is then reduced by thinning thereof in proportion to such reduction in the piston while still providing dynamic balancing thereof. The above dimensional reductions in turn allow compacting of the compressor outline in the longitudinal or axial direction. For example, in an actual construction of the compressor disclosed herein (not including clutch) having a total displacement of about 164 $cm^3$, it was found that its barrel diameter and length could be made as small as about 117 mm and 160 mm respectively and its weight as little as about 3.6 kg.

The pistons' solid seal-support rings 40 are made of a slippery material such as Teflon or the like and are each mounted in a circumferential groove 170(F), 170(R) in the respective pistons heads 38(F), 38(R) of each piston 36. The piston seal-support rings 40 are provided with a nominal unstressed thickness dimension slightly greater than the width of the radial space between the piston head and its respective bore and are provided with a nominal unstressed longitudinal or axial dimension slightly less than the longitudinal or axial dimension of the piston head. The two remaining heads 172(F), 174(F) and 172(R), 174(R) on each of the respective piston heads 38(F), 38(R) that are on opposite sides of the seal-support ring 40 are extremely thin as permitted by their relief from side loading and thus each of the pistons 36 is free to tilt or angle slightly with respect to the paired-cylinder bores therefor. This reduces significantly the criticality of the axial alignment of these bores and thereby increases substantially their manufacturing tolerance further enabling individual boring of the front and rear cylinder blocks rather than as an assembled pair.

Figure 14:
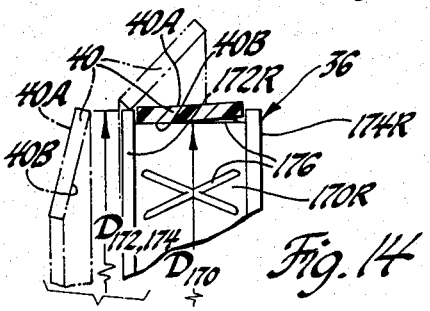
FIG. 14 is an enlarged partial view of one of the piston heads in FIG. 1 showing the assembly of the ring thereon.

With the pistons 36 thus completely supported in their bores by the solid (non-split) seal-support rings 40, it has been found that without further provision as herein disclosed the pistons may then move axially and radially relative to their rings and also in a back and forth rolling sense about the piston's centerline. As to the relative axial movement, this results from end play between the ring and its groove which cannot normally be avoided except by selective fit because of manufacturing tolerances. As to the relative radial movement, this results from the drive engagement between the pistons and the swash plate. As to the relative rolling movement, this results from the clearance between the bridge 39 of the pistons and the periphery of the swash plate 41 as can be seen in FIGS. 1 and 3. This relative piston groove and seal-support ring movement or rubbing can wear the ring groove deeper thereby adversely affecting sealing as well as wear the flat annular face of the groove shoulders at the piston head lands 172 and 174 thereby adversely affecting ring retention and thus again sealing. Such problems are positively avoided by manufacturing (as by cutting) the rings 40 in the shape of a slightly concave washer as shown in FIGS. 14 and 15 and to a certain size in relation to the diameter of the cylinder bores and the bottom of the piston ring grooves and by forming radially outwardly extending projections on the bottom of the ring grooves that will then positively interfere with relative ring and piston movement in both the longitudinal and roll direction. As to the formation of suitable projections on the bottom of the ring grooves this is accomplished by simply knurling or stenciling the bottom of each groove 170 so as to form a series of raised X's or crossbars 176 spaced thereabout with the raised bars or ridges of each at opposite angles to the pistons' longitudinal direction or centerline. The inner diameter (I.D.) of the rings 40 in the as-manufactured-state (washer shape) is made sufficiently small so as to pass with the concave side first over the end land 172 of the piston head with the ring under elastic stress across substantially the entire width thereof (see FIG. 14). This provides each ring with an expanded fit over the end land 172 across substantially its entire width after which the ring contracts within the piston ring groove 170 with its opposite annular sides or faces 40(A) and 40(B) then assuming inner and outer cylindrical surfaces and with substantial radial pressure existing between the bottom of the piston ring groove 170 and the opposing inner cylindrical side or face 40(B) of the ring. With such rings 40 thus assembled on a piston 36, the rings are then radially inwardly compressed such as by passing such piston and ring assembly through a cone so that their outer diameter at side 40(B) is reduced to a dimension equal to or slightly less than the diameter of the cylinder bores 34. The piston 36 with the thus squeezed rings 40 thereon is assembled in its cylinder bores 34(F), 34(R) before the memory of the ring material causes the rings to recover to their original thickness. Then with their memory recovering in the cylinder bores, the rings 40 thereby expand to effect tight sealing engagement therewith as well as prevent relative radial movement between the annular shoulders of the piston ring grooves 170 and the annular edges of the rings in support of the piston head in its cylinder bore. In addition, this piston ring groove and ring relationship and assembly in the cylinder bores causes the raised projections 176 on the bottom of each piston ring groove 170 to bite or imbed into the inner cylindrical face 40(B) of the rings 40 mounted thereon under the contractural force of the ring and the retained compression thereof by its respective cylinder bore. This bite or imbedment is determined to a degree sufficient to anchor the piston against both rotational and longitudinal sliding movement relative to the ring and be maintained by the radial containment of the ring by the cylinder bore in which it slides. Thus, the pistons 36 and their rings 40 are positively prevented from rotating or sliding relative to each other and thereby causing rubbing wear therebetween is prevented for the life of the compressor. For example, in an acutal construction of the compressor disclosed herein, it was found that the above improved results were obtained with cylinder bores of about 38.1 mm when the piston ring groove bottom diameter $D_{170}$ and land diameter $D_{172,\ 174}$ were made about 36.6 mm and 37.9 mm, respectively, the projections 176 were provided with a heighth of 0.05–0.10 mm max., and the seal-support rings 40 in the pre-assembly state (washer shape) was then provided with a thickness of about 5.8 mm and an inner and outer diameter of about 28.5 mm and 40.1 mm, respectively.

While the embodiment of the present invention as herein disclosed constitutes the preferred form, it will be understood by those skilled in the art that other forms may be adopted within the scope of the appended claims.

The embodiments of the invention in which an exclusive property or privilege is claimed are defined as follows:

1. In a compact lightweight multicylinder swash plate compressor of the type having a metallic double-ended piston with piston heads reciprocated in aligned metallic cylinder bores wherein each piston head has a diametrical dimension substantially less than the diametrical dimension of its respective bore to provide a substantial annular space therebetween and wherein a solid seal-support ring of slippery material such as Teflon or the like is expanded over each piston head and contracts into a circumferential groove therein and is sufficiently thick that the memory recovery thereof after further contraction forced by a tool causes the ring to sealingly engage its respective bore immediately after assembly with its piston head therein as the sole support of the piston head with respect to the bore and whereafter the metal of the piston head on opposite sides of the groove is prevented thereby from touching the metal of its respective bore throughout its reciprocation in the bore: the improvement wherein each said groove is formed with a plurality of non-parallel projections which are circumferentially spaced about and project outward from the bottom thereof, said projections projecting sufficiently outward and being configured in non-parallel relationship so that they substantially bite or imbed themselves in the underside of the ring mounted thereover during assembly of the piston heads with the rings thereon in their respective bores whereafter during compressor operation the piston is thereby positively prevented from both rotary and longitudinal rubbing movement in its rings to thereby prevent the rings from wearing away the metal of the piston heads at the bottom and shoulders of their groove whereby both sealing and prevention of metal to metal contact between the piston heads and their respective bore is maintained by the rings.

2. In a compact lightweight multicylinder swash plate compressor of the type having a metallic double-ended piston with piston heads reciprocated in aligned metallic cylinder bores wherein each piston head has a diametrical dimension substantially less than the diametrical dimension of its respective bore to provide a substantial annular space therebetween and wherein a solid seal-support ring of slippery material such as Teflon or the like is expanded over each piston head and contracts into a circumferential groove therein and is sufficiently thick that the memory recovery thereof after further contraction forced by a tool causes the ring to sealingly engage its respective bore immediately after assembly with its piston head therein and whereafter the metal of the piston head on opposite sides of the groove is prevented thereby from touching the metal of its respective bore throughout its reciprocation in the bore: the improvement wherein each said groove is formed with a plurality of non-parallel raised bars or ridges which are circumferentially spaced about and project outward from the bottom thereof, said bars or ridges projecting sufficiently outward and being angled in non-parallel relationship and to the piston's centerline so that they substantially bite or imbed themselves in the underside of the ring mounted thereover during assembly of the piston heads with the rings thereon in their respective bores whereafter during compressor operation the piston is thereby positively prevented from both rotary and longitudinal rubbing movement in its rings to thereby prevent the rings from wearing away the metal of the piston heads at the bottom and shoulders of their groove whereby both sealing and prevention of metal to metal contact between the piston heads and their respective bores is maintained by the rings.

3. In a compact lightweight multicylinder swash plate compressor of the type having a metallic double-ended piston with piston heads reciprocated in aligned metallic cylinder bores wherein each piston head has a diametrical dimension substantially less than the diametrical dimension of its respective bore to provide a substantial annular space therebetween and wherein a solid seal-support ring of slippery material such as Teflon or the like is expanded over each piston head and contracts into a circumferential groove therein and is sufficiently thick that the memory recovery thereof after further contraction forced by a tool causes the ring to sealingly engage its respective bore immediately after assembly with its piston head therein and whereafter the metal of the piston head on opposite sides of the groove is prevented thereby from touching the metal of its respective bore throughout its reciprocation in the bore: the improvement wherein each said groove is formed with a plurality of X-shaped projections which are spaced about and project outward from the bottom thereof, said projections having raised bars or ridges at opposite angles to the piston's centerline projecting sufficiently outward so that they substantially bite or imbed themselves in the underside of the ring mounted thereover during assembly of the piston heads with the rings thereon in their respective bores whereafter during compressor operation the piston is thereby positively prevented from both rotary and longitudinal rubbing movement in its rings to thereby prevent the rings from wearing away the metal of the piston heads at the bottom and shoulders of their groove whereby both sealing and prevention of metal to metal contact between the piston heads and their respective bores is maintained by the rings.

* * * * *